US009663968B2

(12) United States Patent
Witterstaetter et al.

(10) Patent No.: US 9,663,968 B2
(45) Date of Patent: May 30, 2017

(54) LOCKING MECHANISMS FOR SECURITY CONTAINERS

(71) Applicant: Alpha Safe & Vault Inc., Vienna, VA (US)

(72) Inventors: Rich Witterstaetter, Charlotte, NC (US); Nicholas Eugene Henderson, Ryland Heights, KY (US)

(73) Assignee: ALPHA SAFE & VAULT, INC., Vienna, VA (US)

( * ) Notice: Subject to any disclaimer, the term of this patent is extended or adjusted under 35 U.S.C. 154(b) by 0 days.

(21) Appl. No.: 14/660,134

(22) Filed: Mar. 17, 2015

(65) Prior Publication Data

US 2015/0259956 A1 Sep. 17, 2015

Related U.S. Application Data

(60) Provisional application No. 61/954,078, filed on Mar. 17, 2014.

(51) Int. Cl.

| | |
|---|---|
| ***E05B 65/46*** | (2017.01) |
| ***E05B 17/20*** | (2006.01) |
| ***E05B 65/00*** | (2006.01) |
| ***E05C 9/04*** | (2006.01) |

(52) U.S. Cl.

CPC ..... *E05B 17/2038* (2013.01); *E05B 65/0075* (2013.01); *E05B 65/46* (2013.01); *E05C 9/043* (2013.01); *Y10T 292/0964* (2015.04)

(58) Field of Classification Search

CPC ... E05C 9/00; E05C 9/008; E05C 9/04; E05B 63/14

USPC ..... 312/219, 221, 333; 292/32, 33, 37, 42

See application file for complete search history.

(56) References Cited

U.S. PATENT DOCUMENTS

| | | | | | |
|---|---|---|---|---|---|
| 1,611,391 | A | * | 12/1926 | Teich | E05B 13/108 292/348 |
| 1,929,371 | A | * | 10/1933 | Hamilton | E05B 83/247 292/2 |
| 2,793,927 | A | * | 5/1957 | Reitzel | E05B 65/462 292/341.15 |
| 3,497,280 | A | * | 2/1970 | Karel | E05B 65/462 312/219 |
| 3,511,549 | A | * | 5/1970 | Macaluso | E05B 65/462 312/219 |
| 3,592,521 | A | * | 7/1971 | Cox | G07G 1/0027 312/219 |
| 4,609,233 | A | * | 9/1986 | Walla | E05B 65/462 292/141 |

(Continued)

*Primary Examiner* — Matthew Ing

(74) *Attorney, Agent, or Firm* — Dinsmore & Shohl LLP

(57) ABSTRACT

Embodiments described herein are directed to locking mechanisms for security cabinets. In one embodiment, the locking mechanisms for security cabinets provide a visual indication of whether the security cabinet is locked or unlocked. The security containers include a handle assembly that is coupled to the locking mechanism. The handle assembly may be positioned in at least three positions corresponding to the security container being locked and latched; being unlocked and latched; and being unlocked and unlatched. Because the handle assembly is positioned in these plurality of positions that correspond to the lock and latch status of the locking mechanism, indication of the lock and latch status of the locking mechanism may be understood by visual inspection.

20 Claims, 16 Drawing Sheets

(56) References Cited

U.S. PATENT DOCUMENTS 5,385,039 A * 1/1995 Feldpausch ..... E05B 65/462
312/219
8,523,301 B1 * 9/2013 Britson ..... A47B 88/04
312/333

* cited by examiner

LOCKING MECHANISMS FOR SECURITY CONTAINERS

CROSS-REFERENCE TO RELATED APPLICATIONS

The present application claims the benefit of and priority to U.S. Provisional Patent Application No. 61/954,078, filed on Mar. 17, 2014 and entitled "Locking Mechanisms for Security Containers," the entire disclosure of which is hereby incorporated by reference.

TECHNICAL FIELD

The present application generally relates to security containers, more particularly locking security containers and locking mechanisms for locking security containers.

BACKGROUND

Locking security containers are used by end-users who need to secure items with a high degree of confidence. Conventional locking security containers may be utilized by end-users in satisfaction of certain specification including, for example, Federal Specification AA-F-358, which is directed to un-insulated filing cabinets that are designated to meet filing and storage criteria. Such locking security containers are resistant to covert and surreptitious entry.

Conventional locking security containers do not provide a visual indication as to whether the security container itself is locked or unlocked when latched. Accordingly, alternative locking security containers may be desired.

SUMMARY

In one embodiment, a locking mechanism includes a door including an interior facing surface and an exterior facing surface, a handle assembly including a cam that is positioned on the interior facing surface of the door and a handle that is coupled to the cam and is positioned on the exterior facing surface of the door, where the handle is selectively repositionable between a locked handle position and an unlocked and latched handle position, an engagement bolt coupled to the cam and slidably mounted to the interior facing surface of the door, a biasing member coupled to the engagement bolt, where the biasing member applies a force to the engagement bolt biasing the engagement bolt in an inward direction, and a lock including a lock housing and a locking bolt that is selectively repositionable between a locked position to inhibit translation of the engagement bolt and an unlocked position to allow translation of the engagement bolt.

In another embodiment, a locking cabinet includes a frame, a door slidably coupled to the frame, the door including an interior facing surface and an exterior facing surface, a locking mechanism including a handle assembly including a cam that is positioned on the interior facing surface of the door and a handle that is coupled to the cam and is positioned on the exterior facing surface of the door, where the handle is selectively repositionable between a locked handle position, an unlocked and latched handle position, and an unlocked and unlatched handle position, a first engagement bolt coupled to the cam and slidably mounted to the interior facing surface of the door, where the first engagement bolt is selectively engaged with the frame, a second engagement bolt coupled to the cam and slidably mounted to the interior facing surface of the door, where the second engagement bolt is selectively engaged with the frame, a first biasing member coupled to the first engagement bolt, where the first biasing member applies a force to the first engagement bolt biasing the first engagement bolt in an inward direction, and a lock including a lock housing and a locking bolt that is selectively repositionable between a locked position and an unlocked position, where when the locking bolt is in the unlocked position, the first biasing member applies the force to the first engagement bolt and the cam, biasing the handle into the unlocked and latched handle position.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, in which:

DETAILED DESCRIPTION

Various security containers, for example filing cabinets, are used to store sensitive documents and/or materials for personal, commercial, and government applications. The security containers include a locking mechanism that may selectively be locked or unlocked to allow selectively restricted access to the security cabinet. Conventional designs of locking mechanisms for security containers do not provide indication of whether a security cabinet is locked or unlocked. Such convention designs of locking mechanisms therefore require periodic manual inspection to verify the locked/unlocked status of the locking mechanism. Embodiments of the present disclosure are directed to locking mechanisms for security cabinets, and in particular to locking mechanisms for security cabinets that provide a visual indication of whether the security cabinet is locked or unlocked. The security containers include a handle assembly that is coupled to the locking mechanism. The handle assembly may be positioned in at least three positions corresponding to the security container being locked and latched; being unlocked and latched; and being unlocked and unlatched. Because the handle assembly is positioned in these plurality of positions that correspond to the lock and latch status of the locking mechanism, indication of the lock and latch status of the locking mechanism may be readily understood by visual inspection.

Figure 1:
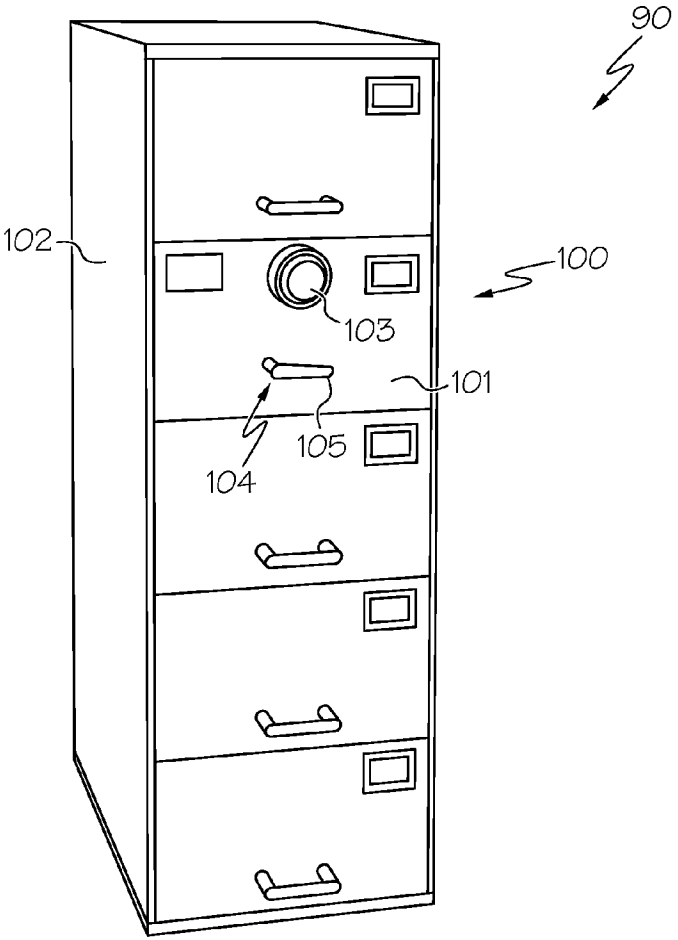
FIG. 1 schematically depicts a locking cabinet with a locking mechanism according to one or more embodiments shown or described herein.

Referring to FIG. 1, a locking cabinet 90 includes a locking mechanism 100, a door 101, and a frame 102. The door 101 and the locking mechanism may be included as part of a drawer of the locking cabinet 90. The door 101 is slidably coupled to the frame 102 such that the door is selectively positionable within the frame 102. The locking cabinet 90 may be utilized to store documents and/or valuables and the locking mechanism 100 provides selective access to the locking cabinet 90.

Figure 2A:
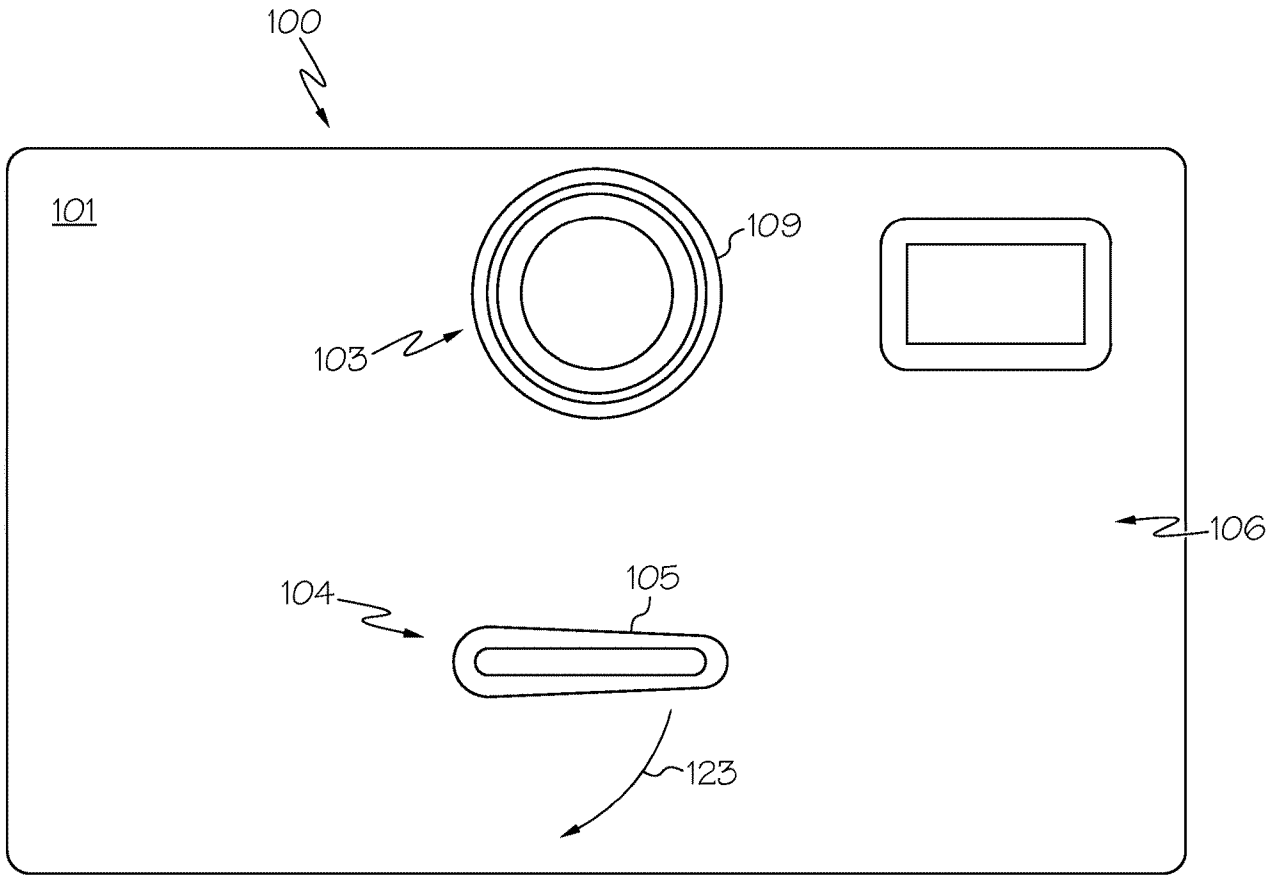
FIG. 2A schematically depicts an outward facing surface of a door and a locking mechanism in a locked position according to one or more embodiments shown or described herein.

Referring to FIG. 2A, the locking mechanism 100 includes a lock 103 and a handle assembly 104 including a handle 105 positioned on an exterior facing surface 106 of the door 101. A user may selectively position the handle assembly 104 to obtain access to an interior of the locking cabinet 90 (FIG. 1), as will be described in greater detail herein. Through selective positioning of the handle assembly 104, the locking mechanism 100 has at least a locked handle position, an unlocked and latched handle position, and an unlocked and unlatched handle position.

Figure 2B:
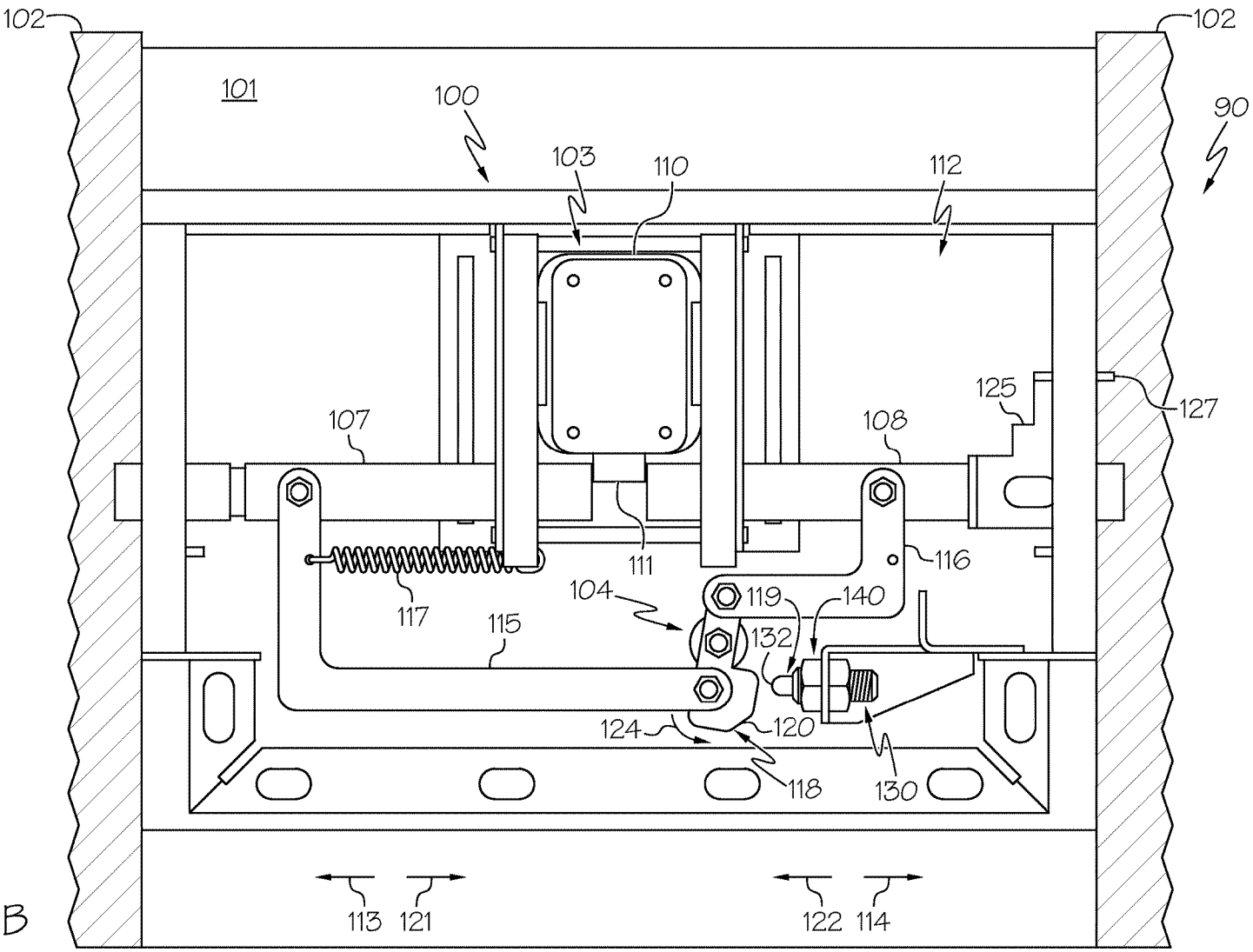
FIG. 2B schematically depicts an inward facing surface of the door and the locking mechanism of FIG. 2A in the locked position according to one or more embodiments shown or described herein.

Referring to FIG. 2B, the locking mechanism 100 includes an engagement bolt and a lock. In one embodiment, the locking mechanism includes a first engagement bolt 107, a second engagement bolt 108, and a lock 103. The first engagement bolt 107 and the second engagement bolt 108 are pivotally coupled to a cam 118 of the handle assembly 104. The first engagement bolt 107 and the second engagement bolt 108 are selectively positioned to engage the frame 102, and are maintained in an engaged position by the lock 103. In the depicted embodiments, the lock 103 of the locking mechanism 100 includes a dial 109 (FIG. 2A), a lock housing 110, and a locking bolt 111. The dial 109 (FIG. 2A) of the lock 103 is positioned on the exterior facing surface 106 of the door 101 and the lock housing 110 and the locking bolt 111 of the lock 103 are positioned on an interior facing surface 112 of the door 101 opposite of the exterior facing surface 106.

The locking bolt 111 of the lock 103 selectively extends outward from the lock housing 110 to a locked position, as shown in FIG. 2B, and may be selectively retracted at least partially into the lock housing 110 to an unlocked position.

The dial 109 (FIG. 2A) of the lock 103 may be manipulated by a user. To change the locking bolt 111 from the locked position to the unlocked position, a user inputs a rotational sequence using the dial 109. The rotational sequence of the dial 109 is communicated to a tumbler (not depicted) of the lock 103. If the user inputs the correct sequence to the tumbler using the dial 109, the locking bolt 111 retracts from the locked position to the unlocked position. If the user does not input the correct sequence using the dial 109, the locking bolt 111 remains in the locked position, as shown in FIG. 2B. In one embodiment the lock 103 is an electro-mechanical lock that meets United States General Services Administration (GSA) Federal Standard FF-L-2740. In another embodiment, the lock 103 may be a mechanical lock that meets United States GSA Federal Standard FF-L-2937. In other embodiments, the locking bolt 111 changes from the locked position to the unlocked position when so-selected by a key inserted into the lock 103, by the input of a sequence using a keypad (not depicted), by the input of biometric information, or by other inputs known in the art.

Still referring to FIG. 2B, the first engagement bolt 107 and the second engagement bolt 108 are slidably mounted on the door 101. The first engagement bolt 107 selectively extends outward from the door 101 in an outward direction 113. Similarly, the second engagement bolt 108 selectively extends outward from the door 101 in an outward direction 114.

The locking mechanism includes an engagement leg that is pitovally coupled to the cam 118 and at least one of the first engagement leg 115 and the second engagement leg 116. A first engagement leg 115 and a second engagement leg 116 are coupled to the first engagement bolt 107 and the second engagement bolt 108, respectively. The first engagement leg 115 and the second engagement leg 116 are pivotally coupled to the cam 118 of the handle assembly 104, thereby coupling the first engagement bolt 107 and the second engagement bolt 108 to the cam 118. The first engagement leg 115 and the second engagement leg 116 may be generally rigid bodies that transfer force to reposition the first engagement bolt 107 and the second engagement bolt 108 without deformation.

The locking mechanism 100 includes a biasing member. In one embodiment, the locking mechanism 100 includes a first biasing member 117. The first biasing member 117 is positioned towards the interior facing surface 112 of the door 101. The first biasing member 117 is coupled to the door 101 and to the first engagement leg 115, which is coupled to the first engagement bolt 107. The first biasing member 117 applies a force to the first engagement leg 115 that biases the first engagement leg 115 in an inward direction 121. The first biasing member 117 applies a force to the first engagement bolt 107 through the first engagement leg 115 that biases the first engagement bolt 107 in the inward direction 121 (i.e., in a direction away from engagement with the frame 102). In embodiments, the first biasing member 117 is a tension spring. In alternative embodiments, the first biasing member 117 may be a torsion spring or a compression spring, acting to bias the first engagement leg 115, and thus the first engagement bolt 107, in the inward direction 121.

As described above, the locking mechanism 100 includes the handle assembly 104, a portion of which is positioned towards the interior facing surface 112 of the door 101 and a portion of which is positioned towards the exterior facing surface 106 (FIG. 2A) of the door 101. Referring to FIG. 2A, the handle assembly 104 includes a handle 105 positioned on the exterior facing surface 106 of the door 101. The handle 105 may have a generally elongated shape that may be gripped by a user's hand. In the depicted embodiment, the handle 105 pivots in direction 123.

Referring to FIG. 2B, the handle assembly 104 further includes the cam 118 coupled to the handle 105 and positioned towards the interior facing surface 112 of the door 101. Referring collectively to FIGS. 2A and 2B, the cam 118 is coupled to the handle 105 such that when the handle 105 pivots towards direction 123, the cam 118 pivots in direction 124. Likewise, when the cam 118 pivots in direction 124, the handle 105 pivots in direction 123. As depicted in FIGS. 2A and 2B, direction 123 is shown as the clockwise direction and direction 124 is shown as the counter-clockwise direction. However it should be understood that direction 123 and direction 124 depict the same direction of rotation with different frames of reference with respect to door 101.

Referring again to FIG. 2B, the cam 118 is pivotally coupled to the first engagement leg 115 and the second engagement leg 116. As the cam 118 pivots in direction 124, the first engagement leg 115 and the second engagement leg 116 are repositioned following the direction of movement of the cam 118. As the cam 118 pivots in direction 124, the first engagement leg 115 is repositioned in the inward direction 121. As the first engagement leg 115 is repositioned in the inward direction 121, the first engagement bolt 107 is repositioned in the inward direction 121. Similarly, as the cam 118 pivots in direction 124, the second engagement leg 116 is repositioned in the inward direction 122. As the second engagement leg 116 is repositioned in the inward direction 122, the second engagement bolt 108 is repositioned in the inward direction 122.

In embodiments, the locking cabinet 90 further includes a second biasing member 119 mounted towards the interior facing surface 112 of the door 101. In FIGS. 2B-4C, the second biasing member 119 is a plunger spring assembly having a spring-loaded plunger 132 that extends outwards of a housing 130. In alternative embodiments, the second biasing member 119 may be a torsion spring or a tension spring. The second biasing member 119 is positioned to engage a surface 120 of the cam 118 as the cam 118 pivots in direction 124. While the surface 120 of the cam 118 is depicted as a faceted surface, it should be understood that the surface 120 having a variety of shapes may be incorporated into the locking mechanism 100, including surfaces having a generally cylindrical configuration, without departing from the scope of the present disclosure. The second biasing member 119 is positioned such that the second biasing member 119 does not contact the surface 120 of the cam 118 when the locking mechanism 100 is in the locked position, as shown in FIG. 2B. When the locking mechanism 100 is outside of the locked position (i.e., when the handle assembly 104 is moving towards the unlocked and unlatched position), the second biasing member 119 contacts the surface 120 of the cam 118.

The second biasing member 119 may be mounted on the interior facing surface 112 of the door 101 by a pair of jam nuts 140 that engage threads on the second biasing member 119. By mounting the second biasing member 119 using the pair of jam nuts 140, the linear position of the second biasing member 119 may be adjusted in the inward direction 122 or the outward direction 114 to adjust the position of the second biasing member 119 in relation to the cam 118, thereby accommodating various positions of the cam 118. The second biasing member 119 may be positioned such that the second biasing member 119 is free from contact with the cam 118 when the handle assembly 104 is positioned in the locked handle position (FIG. 2B) and/or the unlocked and latched handle position (FIG. 3B). When the handle assembly 104 is repositioned away from the unlocked and latched handle position (FIG. 3B) towards the unlocked and unlatched handle position (FIG. 4B), the cam 118 will come into contact with the second biasing member 119. Therefore, when the handle assembly 104 is positioned outside of the unlocked and latched handle position towards the unlocked and unlatched handle position, the second biasing member 119 will apply a biasing force to the cam 118 in a direction that tends to return the cam 118 to the unlocked and latched handle position.

Figure 4A:
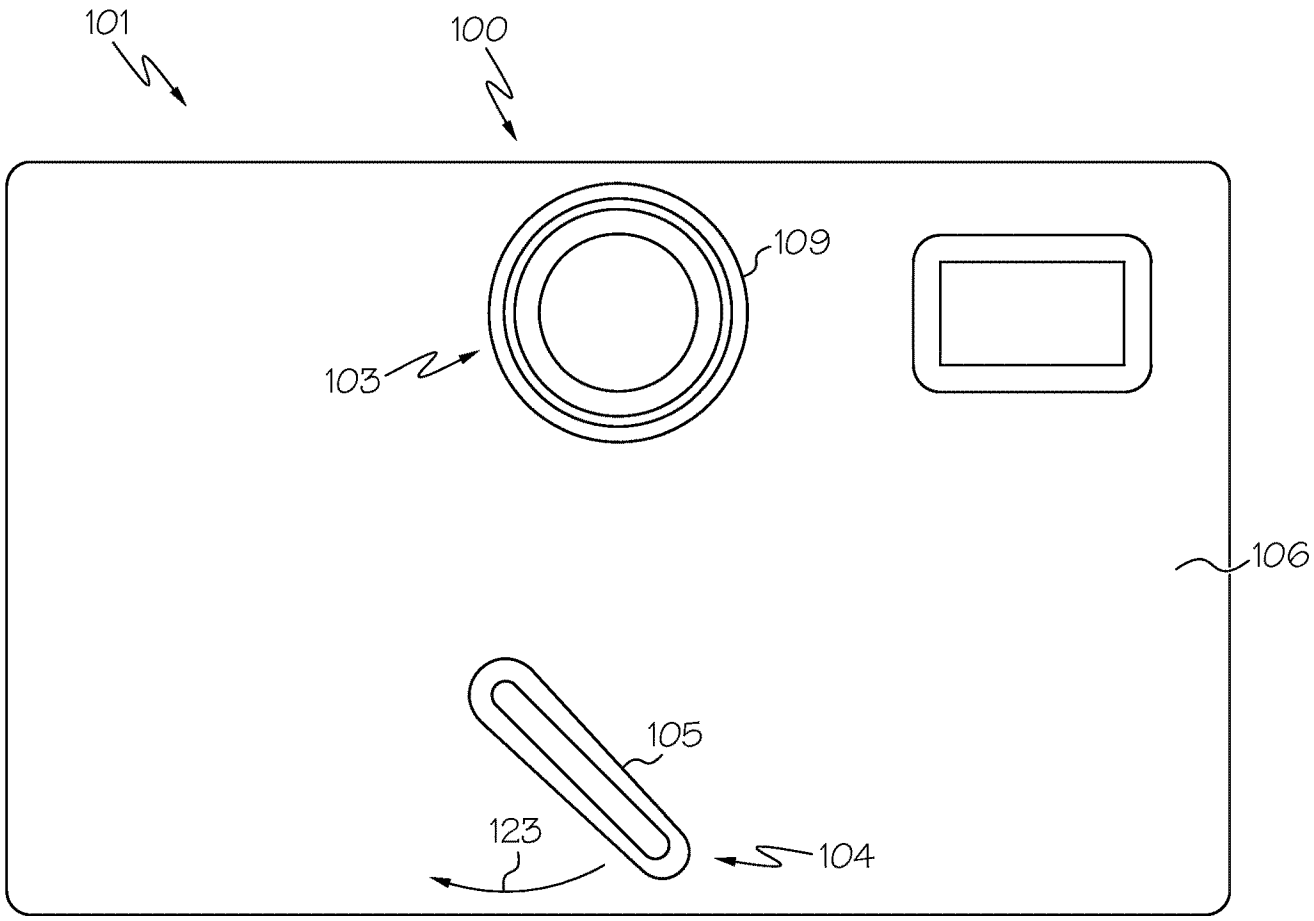
FIG. 4A schematically depicts the outward facing surface of the door and the locking mechanism of FIG. 2A in an unlocked and unlatched position according to one or more embodiments shown or described herein.
Figure 4B:
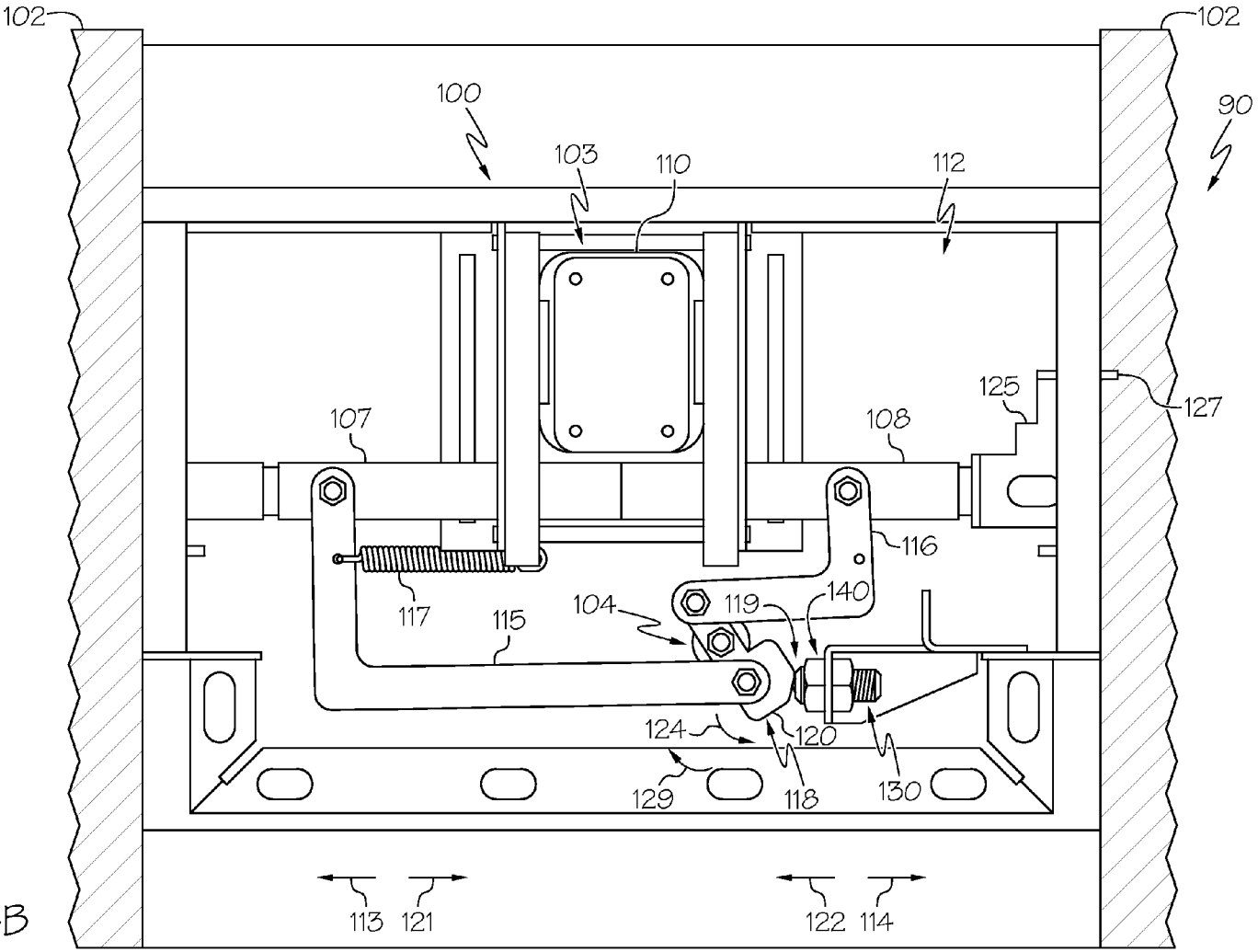
FIG. 4B schematically depicts the inward facing surface of the door and the locking mechanism of FIG. 4A in the unlocked and unlatched position according to one or more embodiments shown or described herein.
Figure 4C:
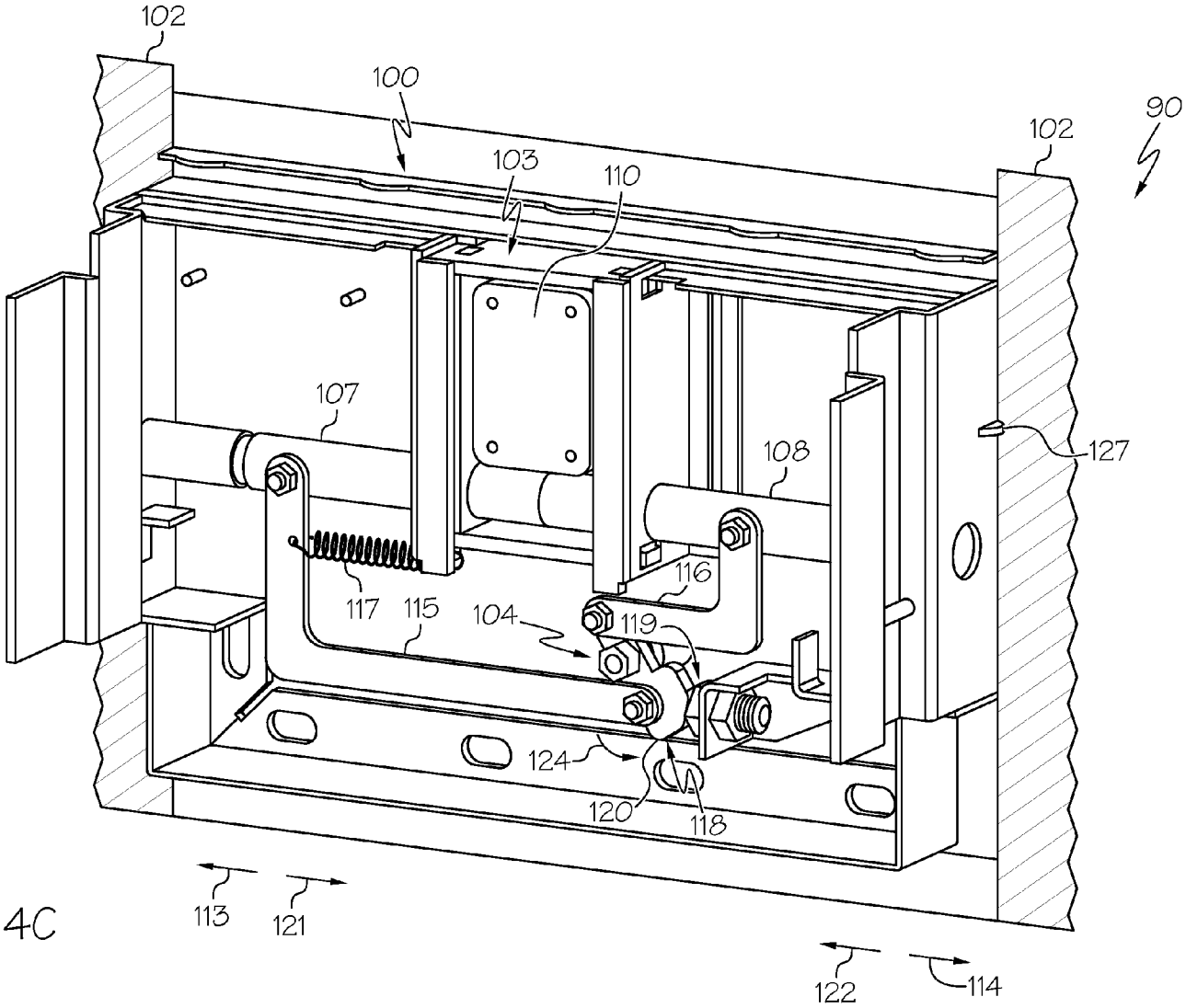
FIG. 4C schematically depicts a perspective view of the inward facing surface of the door and the locking mechanism of FIG. 4A in the unlocked and unlatched position according to one or more embodiments shown or described herein.
Figure 4D:
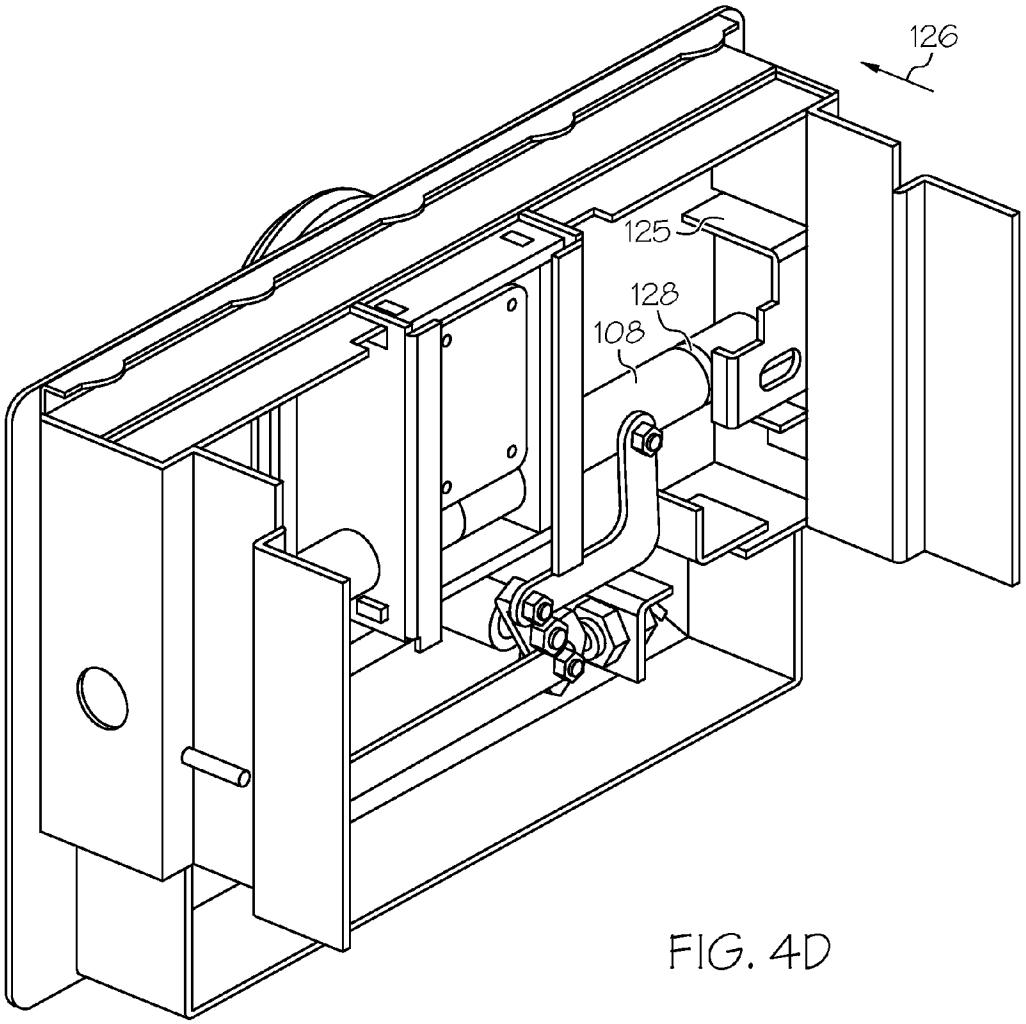
FIG. 4D schematically depicts a perspective view of the inward facing surface of the door, a latch, and a locking mechanism in the unlocked and unlatched position according to one or more embodiments shown or described herein.

Referring to FIG. 4D, the locking mechanism may also include a latch 125. The latch 125 is coupled to the door 101 and is positioned towards the interior facing surface 112 of the door 101. In the depicted embodiment, the latch 125 is positioned proximate to the second engagement bolt 108. The latch 125 is configured to engage the second engagement bolt 108 when the locking mechanism 100 is in the unlocked and unlatched position. In the depicted embodiments, the latch 125 is biased in direction 126 toward the exterior facing surface 106 of the door 101, and the latch 125 engages a recess 128 in the second engagement bolt 108. As the latch 125 engages the second engagement bolt 108 when the locking mechanism 100 is in the unlocked and unlatched position, the latch 125 retains the second engagement bolt 108 in the unlocked and latched position.

Referring back to FIG. 2B, the latch 125 includes a tab 127 that extends outward from the door 101. When the door 101 is returned to a closed state in the locking cabinet 90, the tab 127 contacts the frame 102 of the locking cabinet 90. As the tab 127 contacts the frame 102 of the locking cabinet 90, the frame 102 applies a force to the tab 127 that deflects the latch 125. The deflection of the tab 127 by the frame 102 overcomes the biasing force of the latch 125 relies on to engage the second engagement bolt 108, thereby causing the latch 125 to disengage the second engagement bolt 108, and allowing the first engagement bolt 107 and the second engagement bolt 108 to return to an unlocked and latched state.

Figure 2C:
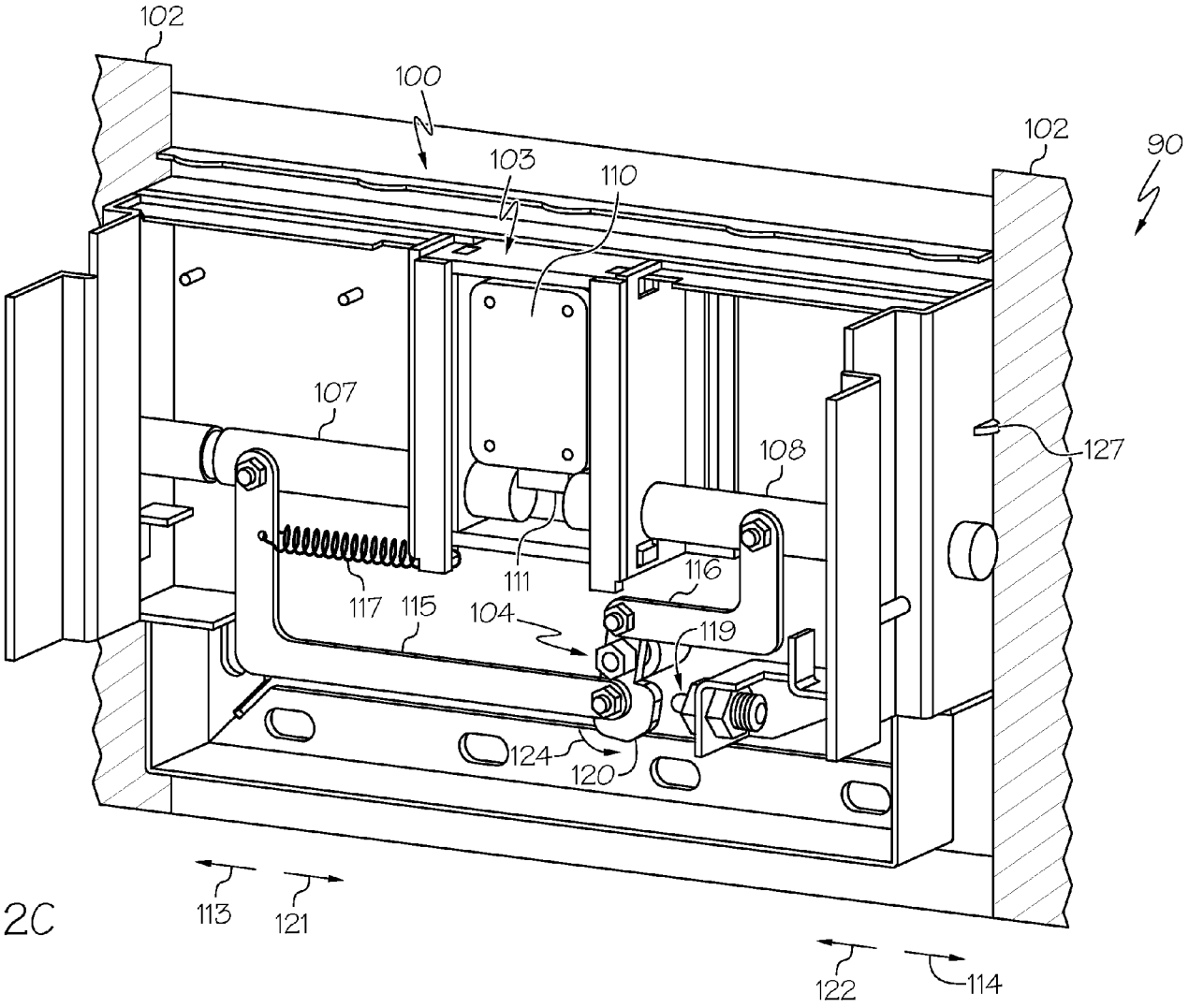
FIG. 2C schematically depicts a perspective view of the inward facing surface of the door and the locking mechanism of FIG. 2A in the locked position according to one or more embodiments shown or described herein.

The operation of the locking mechanism 100 transitioning between the locked position, the unlocked and latched position, and the unlocked and unlatched position will now be described. As depicted in FIGS. 2A, 2B, and 2C, the locking mechanism 100 is in the locked position. The first engagement bolt 107 extends outward from the door 101 and engages the frame 102 of the locking cabinet 90. The second engagement bolt 108 extends outward from the door 101 and engages the frame 102 of the locking cabinet 90. With the first engagement bolt 107 engaged with the frame 102, and the second engagement bolt 108 engaged with the frame 102, the door 101 of the locking mechanism 100 is retained in place. Further, the locking bolt 111 is extended from the lock housing 110, preventing translation of the first engagement bolt 107 and the second engagement bolt 108, and thereby preventing access to an interior portion of the locking cabinet 90. While the embodiment depicted in FIGS. 2B and 2C depict the first engagement bolt 107 and the second engagement bolt 108 engaging the frame 102 by extending behind the frame 102, other embodiments of retaining the door 101 in place are contemplated. For example, the frame 102 may include a first aperture (not depicted) and a second aperture (not depicted). The first engagement bolt 107 and the second engagement bolt 108 may be extended within the first aperture and the second aperture of the frame 102, respectively.

In an additional embodiment, the first engagement bolt 107 and the second engagement bolt 108 may engage a first vertical bar (not depicted) and a second vertical bar (not depicted) within the frame 102, where the first vertical bar and the second vertical bar control access to other doors of the locking cabinet 90 (see FIG. 1). Accordingly, the locking mechanism 100 may be used to control access to multiple doors of a locking cabinet 90.

Referring in particular to FIG. 2A, when the locking mechanism 100 is in the locked position, the handle 105 of the handle assembly 104 is in a locked handle position. In particular, in the locked handle position, the handle 105 is oriented in a first rotational position, which may be in a horizontal direction or a near horizontal direction.

Figure 3A:
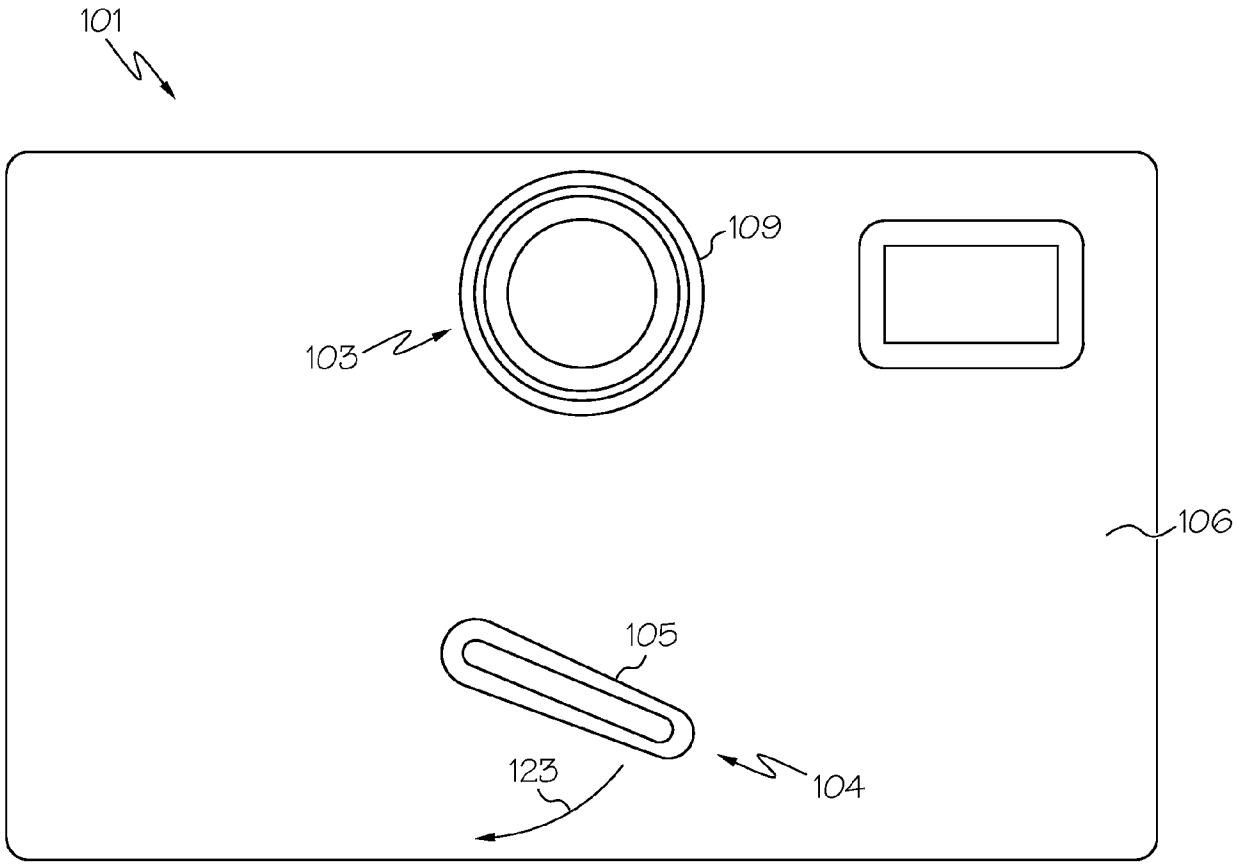
FIG. 3A schematically depicts the outward facing surface of the door and the locking mechanism of FIG. 2A in an unlocked and latched position according to one or more embodiments shown or described herein.
Figure 3B:
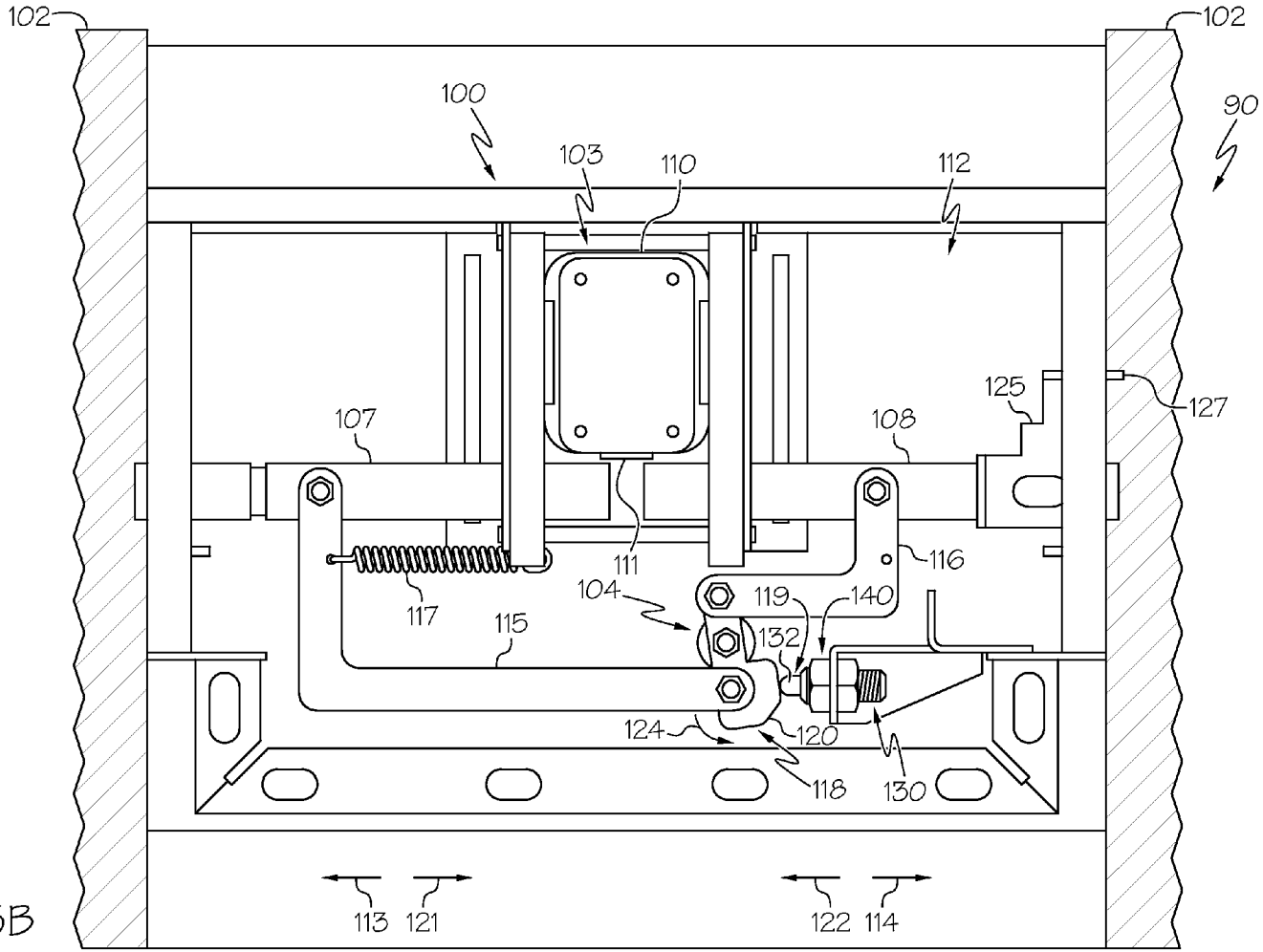
FIG. 3B schematically depicts the inward facing surface of the door and the locking mechanism of FIG. 3A in the unlocked and latched position according to one or more embodiments shown or described herein.
Figure 3C:
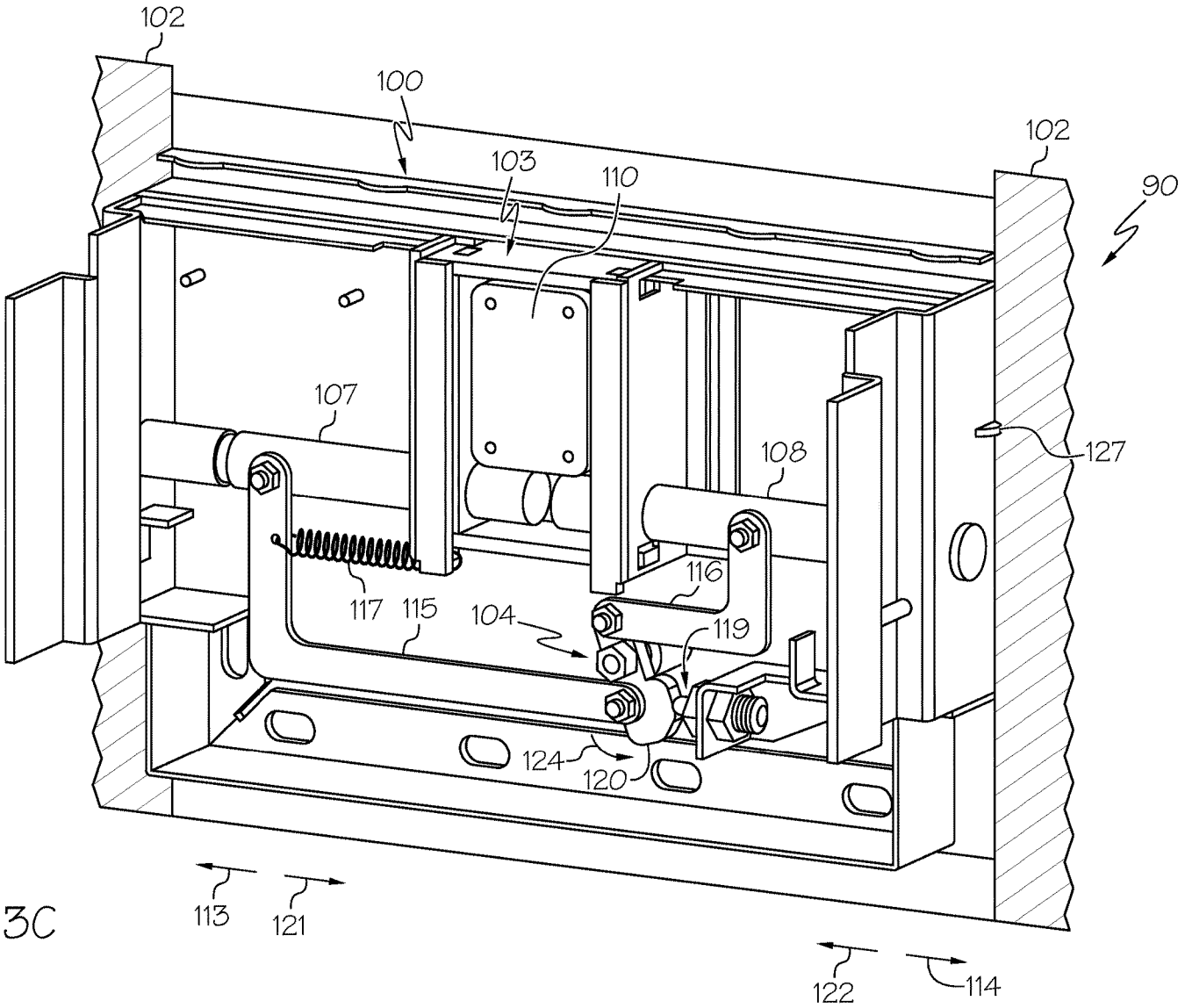
FIG. 3C schematically depicts a perspective view of the inward facing surface of the door and the locking mechanism of FIG. 3A in the unlocked and latched position according to one or more embodiments shown or described herein.

Referring to FIGS. 3A, 3B, and 3C, the locking mechanism 100 is depicted in the unlocked and latched position. In the unlocked and latched position, the locking bolt 111 of the lock 103 is retracted and maintained in an unlocked position, in which the locking bolt 111 of the lock 103 is retracted away from the first engagement bolt 107 and the second engagement bolt 108. With the locking bolt 111 in the unlocked position, the first biasing member 117 draws the first engagement leg 115 in the inward direction 121. As the first biasing member 117 draws the first engagement leg 115 in inward direction 121, the first engagement leg 115 draws the first engagement bolt 107 in inward direction 121. As the first engagement bolt 107 is drawn in inward direction 121, the first engagement bolt 107 is at least partially withdrawn from the frame 102.

The repositioning of the first engagement leg 115 by the first biasing member 117 also causes the cam 118 to pivot in direction 124 as the cam 118 is pivotally coupled to the first engagement leg 115. As the cam 118 pivots, the cam 118 draws the second engagement leg 116 in the inward direction 122. As the second engagement leg 116 is drawn in the inward direction 122, the second engagement bolt 108 is at least partially retracted from the frame 102.

As the cam 118 pivots, a surface 120 of the cam 118 may be brought into contact with the second biasing member 119. The second biasing member 119 exerts a force on the surface 120 of the cam 118 opposing the rotation of the cam 118 in direction 124. As the surface 120 of the cam 118 is brought into contact with the second biasing member 119, the second biasing member 119 applies a force to the cam 118 in a direction in opposition to the force exerted on the cam 118 from the first biasing member 117 through the first engagement leg 115. The opposing biases of the first biasing member 117 and the second biasing member 119 maintain the position of the cam 118 such that the first engagement bolt 107 and the second engagement bolt 108 are maintained in a partially retracted position from the frame 102.

While the first engagement bolt 107 and the second engagement bolt 108 are partially retracted from the frame 102, the first engagement bolt 107 and the second engagement bolt 108 remain at least partially engaged with the frame 102, thereby latching the door 101 to the frame 102.

As the cam 118 is rotated by the first biasing member 117 through the first engagement leg 115, the cam 118 pivots the handle 105 of the handle assembly 104 about the cam 118. As the cam 118 pivots the handle 105, the handle 105 pivots in direction 123 from the position of the handle 105 in the locked handle position, such that the handle 105 is no longer oriented in the first rotational position and is instead oriented in a second rotational position in the unlocked and latched handle position. Accordingly, based on the position of the handle 105, the status of the locking mechanism 100 as being outside of the locked handle position is readily visible to an observer.

Referring now to FIGS. 4A, 4B, 4C, and 4D, one embodiment of the locking mechanism 100 is depicted in the unlocked and unlatched position. The locking bolt 111 of the lock 103 is maintained in the unlocked position, and the first engagement bolt 107 and the second engagement bolt 108 are fully retracted from the frame 102, allowing the door 101 to be disengaged from the frame 102 so that an interior of the locking cabinet 90 may be accessed.

To retract the first engagement bolt 107 and the second engagement bolt 108 from the frame 102, a user may manipulate the handle 105 of the handle assembly 104 to pivot in direction 123 from the unlocked and latched position. As the handle 105 pivots about the cam 118, the handle 105 causes the cam 118 to pivot in direction 124. Accordingly, as shown in FIG. 4A, in the unlocked and unlatched handle position, the handle 105 is oriented in a third rotational position.

To unlatch the locking cabinet 90, enough force must be applied to the handle 105 to overcome the biasing force of the second biasing member 119 on the cam 118. As the cam 118 is rotated into the unlatched position by the handle 105, the cam 118 repositions the first engagement leg 115 in the inward direction 121, and the second engagement leg 116 in the inward direction 122. The cam 118 repositions the first engagement leg 115 in the inward direction 121, and the first engagement leg 115 consequently repositions the first engagement bolt 107 in the inward direction 121. Similarly, the cam 118 repositions the second engagement leg 116 in the inward direction 122, and the second engagement leg 116 consequently repositions the second engagement bolt 108 in the inward direction 122.

In the unlocked and unlatched position, the first engagement bolt 107 and the second engagement bolt 108 are fully withdrawn within the door 101. As the second engagement bolt 108 is drawn in the inward direction 122, the latch 125 engages the second engagement bolt 108. As the latch 125 engages the second engagement bolt 108, the latch 125 maintains the position of the second engagement bolt 108 as being retracted within the door 101, thereby maintaining the second engagement bolt 108 in the unlocked and unlatched position. By maintaining the position of the second engagement bolt 108, the latch 125 opposes the biasing force of the second biasing member 119.

As the latch 125 retains the position of the second engagement bolt 108, the latch 125 maintains the position of the cam 118 in the unlocked and unlatched position through the second engagement leg 116. As the cam 118 is maintained in position, the cam 118 maintains the position of the first engagement leg 115 in a retracted position. As the position of the first engagement leg 115 is maintained in the unlocked and unlatched position by the cam 118, the first engagement leg 115 maintains the position of the first engagement bolt 107 in the unlocked and unlatched position, with the first engagement bolt 107 fully withdrawn within the door 101. Accordingly, the latch 125 acts to maintain the positions of the first engagement bolt 107 and the second engagement bolt 108 in the unlocked and unlatched position.

With the first engagement bolt 107 and the second engagement bolt 108 fully withdrawn within the door 101, the interior of the locking cabinet 90 may be accessed by pulling the door 101 away from the frame 102.

When the door 101 is pushed back into the frame 102 in the unlocked and unlatched position, the tab 127 of the latch 125 engages the frame 102. As the tab 127 engages the frame 102, the tab 127 of the latch 125 causes the latch 125 to disengage from the second engagement bolt 108. As the latch 125 disengages from the second engagement bolt 108, the second biasing member 119 causes the cam 118 to pivot in direction 129 opposite of direction 124. As the cam 118 is pivoted in direction 129, the cam 118 returns the locking mechanism 100 to the unlocked and latched position, as shown in FIGS. 3A-3C.

Figure 5A:
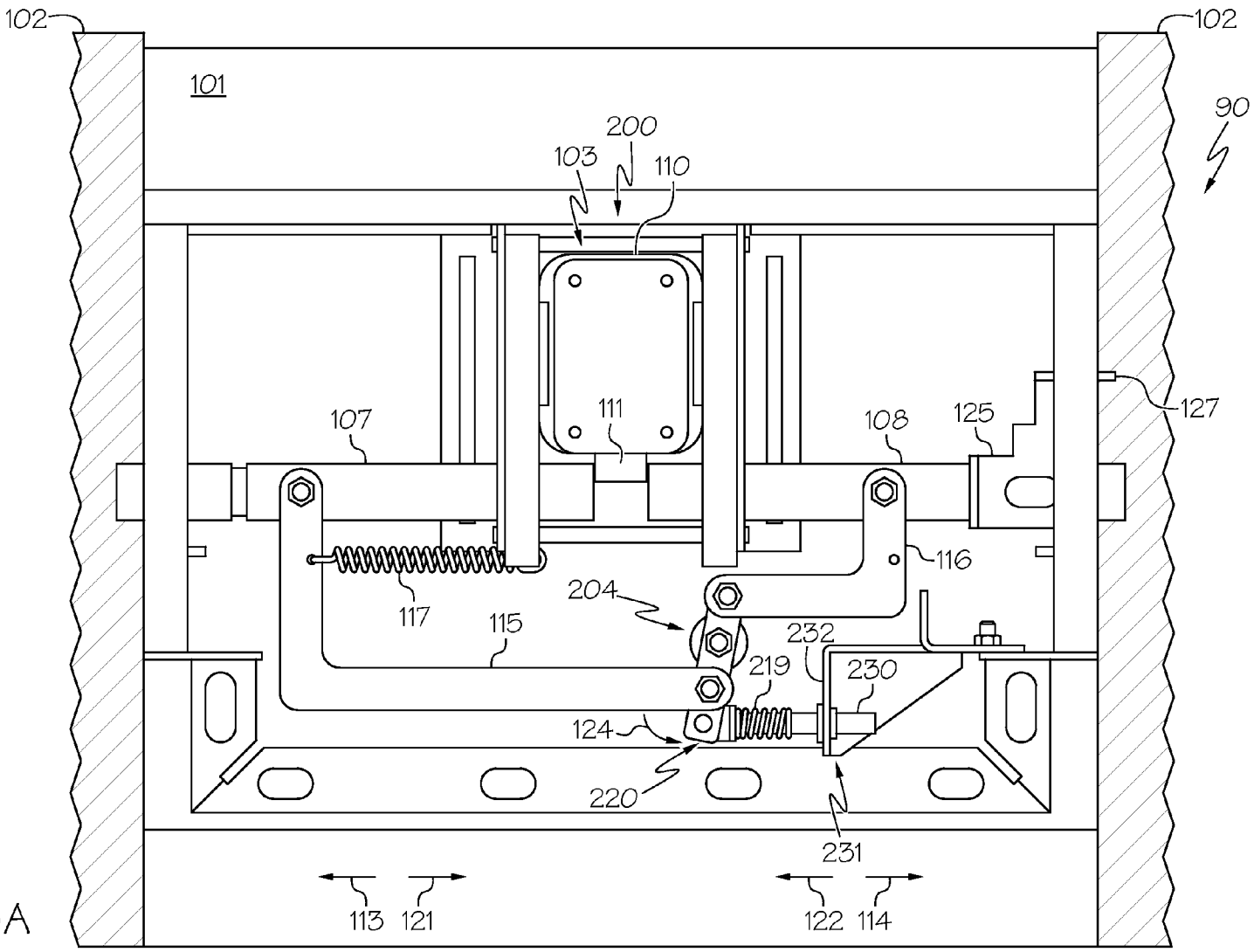
FIG. 5A schematically depicts the inward facing surface of the door and a locking mechanism in a locked position according to one or more embodiments shown or described herein.
Figure 5B:
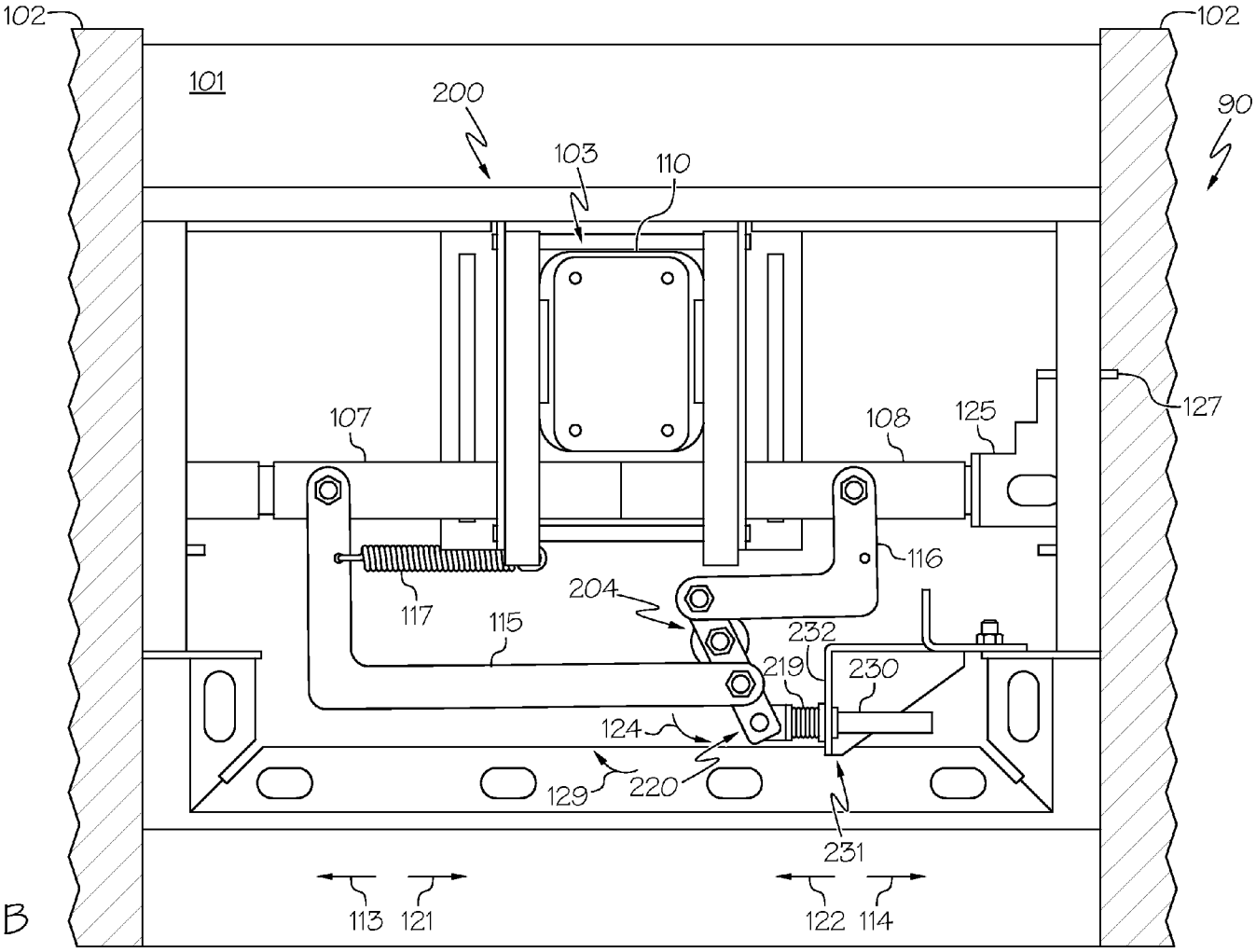
FIG. 5B schematically depicts the inward facing surface of the door and the locking mechanism of FIG. 5A in an unlocked and unlatched position according to one or more embodiment shown or described herein.

Referring to FIGS. 5A and 5B, in another embodiment, the locking mechanism 200 includes a second biasing member 219 that is pivotally coupled to a cam 220 of a handle assembly 204. As described above with respect to FIGS. 2A and 2B, the locking mechanism 200 includes the first engagement bolt 107 coupled to the first engagement leg 115 and the second engagement bolt 108 coupled to the second engagement leg 116. The first engagement leg 115 and the second engagement leg 116 are pivotally coupled to the cam 220. In this embodiment, the second biasing member 219 is coupled to the cam 220.

The second biasing member 219 positioned on a guide 230 that is pivotally coupled to the cam 220 and is slidably inserted into a bracket 231 that is coupled to the door 101. In embodiments, the second biasing member 219 may include a compression spring. The bracket 231 includes a surface 232 that is positioned proximate to the second biasing member 219. The second biasing member 219 is positioned to engage the surface 232 of the bracket 231 as the cam 220 pivots in direction 124. The second biasing member 219 is positioned such that the second biasing member 219 does not contact the surface of the bracket 231 when the locking mechanism 100 is in the locked position, as shown in FIG. 5A. When the locking mechanism 200 is outside of the locked position (i.e., when the handle assembly 204 is moving towards the unlocked and unlatched position), the second biasing member 219 contacts the surface 232 of the bracket 231.

In operation, similar to the embodiment described above with respect to FIGS. 2A-4D, the handle 105 of the locking mechanism 200 is selectively positioned between the locked handle position, the unlocked and latched handle position, and the unlocked an unlatched handle position, in which the handle 105 is oriented in the first rotational position, the second rotational position, and the third rotational position, respectively. In particular, as the locking bolt 111 of the lock retracts into the lock housing 110 of the lock 103, the first biasing member 117, which is coupled to the first engagement bolt 107 through the first engagement leg 115, causes the first engagement bolt 107 to translate in the inward direction 121. Translation of the first engagement leg 115 in the inward direction 121 causes the cam 220 to rotate in the direction 124, thereby causing the second engagement leg 116 and the second engagement bolt to translate in the inward direction 122. Rotation of the cam 220 in direction 124 causes the guide 230 and the second biasing member 219 to translate and contact and engage the surface 232 of the bracket 231.

Upon contact with the bracket 231, the second biasing member 219 applies a force to the cam 220 that opposes the first biasing member 117. In this way, the second biasing member 219 acts to maintain the locking mechanism in the unlocked and latched position, as describe above with respect to FIGS. 3A-3C. By rotating the handle 205 (FIG. 4A), a user may reposition the locking mechanism 200 into the unlocked and latched position, as described above with respect to FIGS. 4A-4D.

Figure 6A:
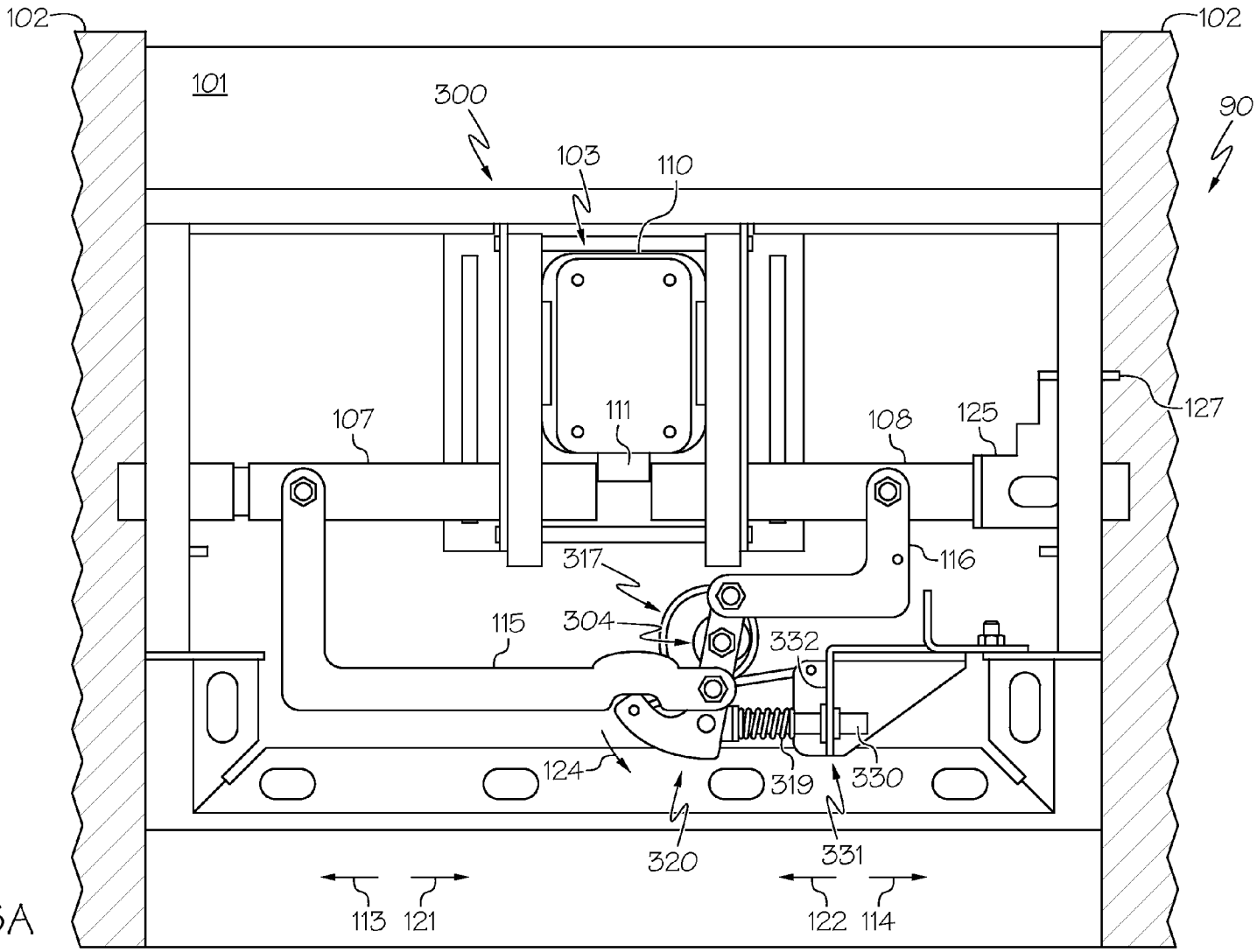
FIG. 6A schematically depicts the inward facing surface of the door and a locking mechanism in a locked position according to one or more embodiments shown or described herein.

Referring to FIG. 6A, in another embodiment, the locking mechanism 300 includes a first biasing member 317 that is coupled to a cam 320 of the handle assembly 304. As described above with respect to FIGS. 2A-4C, the locking mechanism 300 includes the first engagement bolt 107 coupled to the first engagement leg 115 and the second engagement bolt 108 coupled to the second engagement leg 116. Similarly, the first engagement leg 115 and the second engagement leg 116 are pivotally coupled to the cam 320. The locking mechanism 300 includes the second biasing member 319 coupled to the cam 320 and positioned on the guide 330 that is slidably inserted into the bracket 331. In this embodiment, the first biasing member 317 is coupled to the cam 320 and the door 101.

The first biasing member 317 is coupled to the cam 320 and the bracket 331 of the door 101 and applies a rotational force to the cam 320 biasing the cam 320 to a rotational position. In embodiments, the first biasing member 317 may include a torsion spring coupled to the cam 320 and the bracket 331. In particular, the first biasing member 317 may bias the cam 320 to rotate in direction 124 such that the first engagement leg 115 and thus the first engagement bolt 107 translate inward in the inward direction 121. Similarly, the first biasing member may bias the cam 320 to rotate such that the second engagement leg 116 and thus the second engagement bolt 108 translates inward in the inward direction 122.

Figure 6B:
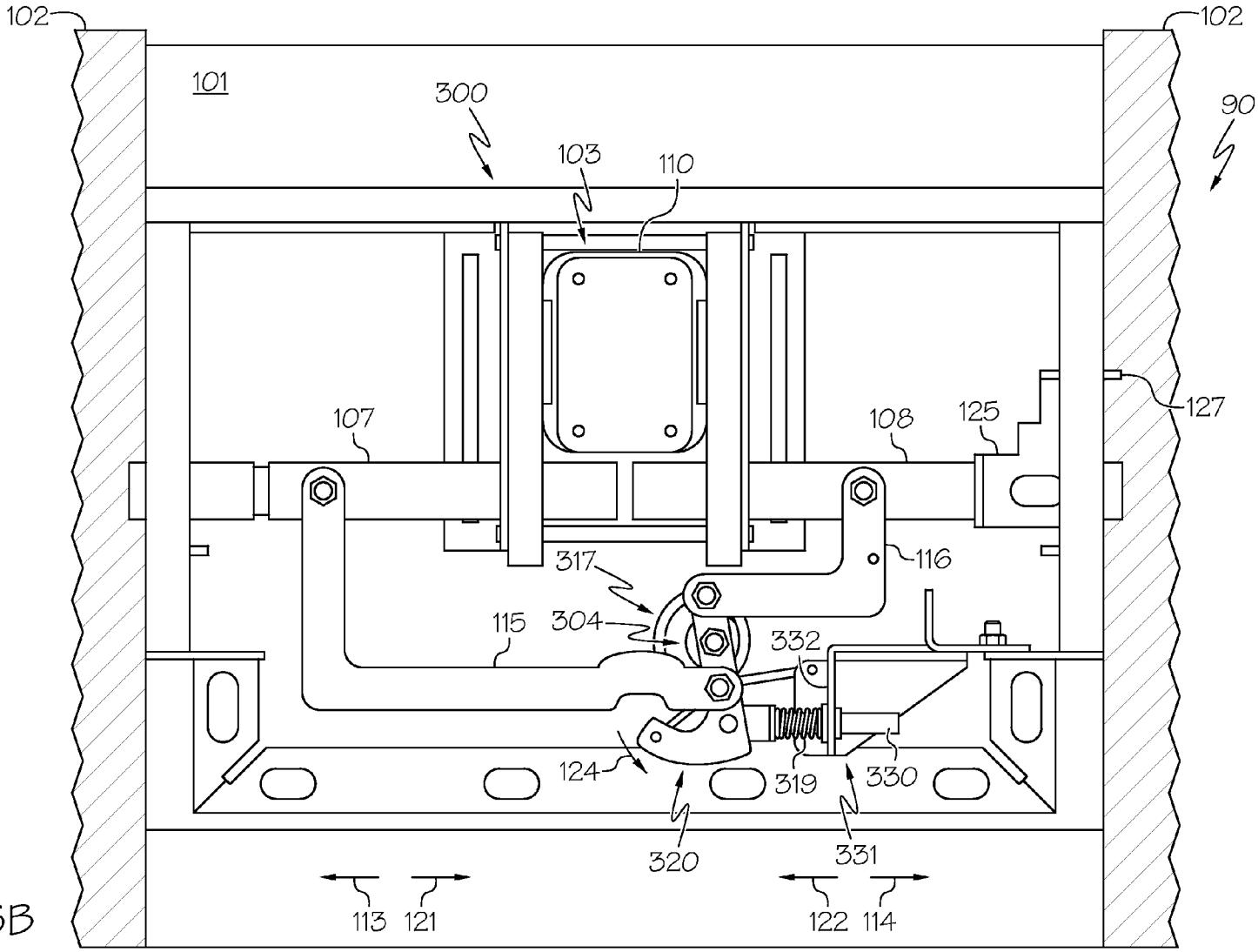
FIG. 6B schematically depicts the inward facing surface of the door and the locking mechanism of FIG. 6A in an unlocked and latched position according to one or more embodiments shown or described herein.

In operation, similar to the embodiment described above with respect to FIGS. 2A-4D, the handle 105 of the locking mechanism 300 is selectively positioned between the locked handle position, the unlocked and latched handle position, and the unlocked an unlatched handle position, in which the handle 105 is oriented in the first rotational position, the second rotational position, and the third rotational position, respectively. Referring to FIG. 6B, as the locking bolt 111 of the lock retracts into the lock housing 110 of the lock 103, the first biasing member 317 causes the cam 320 to rotate in direction 124. As the first engagement bolt 107 is coupled to the cam 320 through the first engagement leg 115, the first biasing member 317 causes the first engagement bolt 107 to translate in the inward direction 121. Similarly, through rotation of the cam 320 in the direction 124, the first biasing member 317 causes the second engagement leg 116 and the second engagement bolt to translate in the inward direction 122. Rotation of the cam 320 in direction 124 causes the guide 330 and the second biasing member 319 to translate and contact and engage the surface 332 of the bracket 331.

Figure 6C:
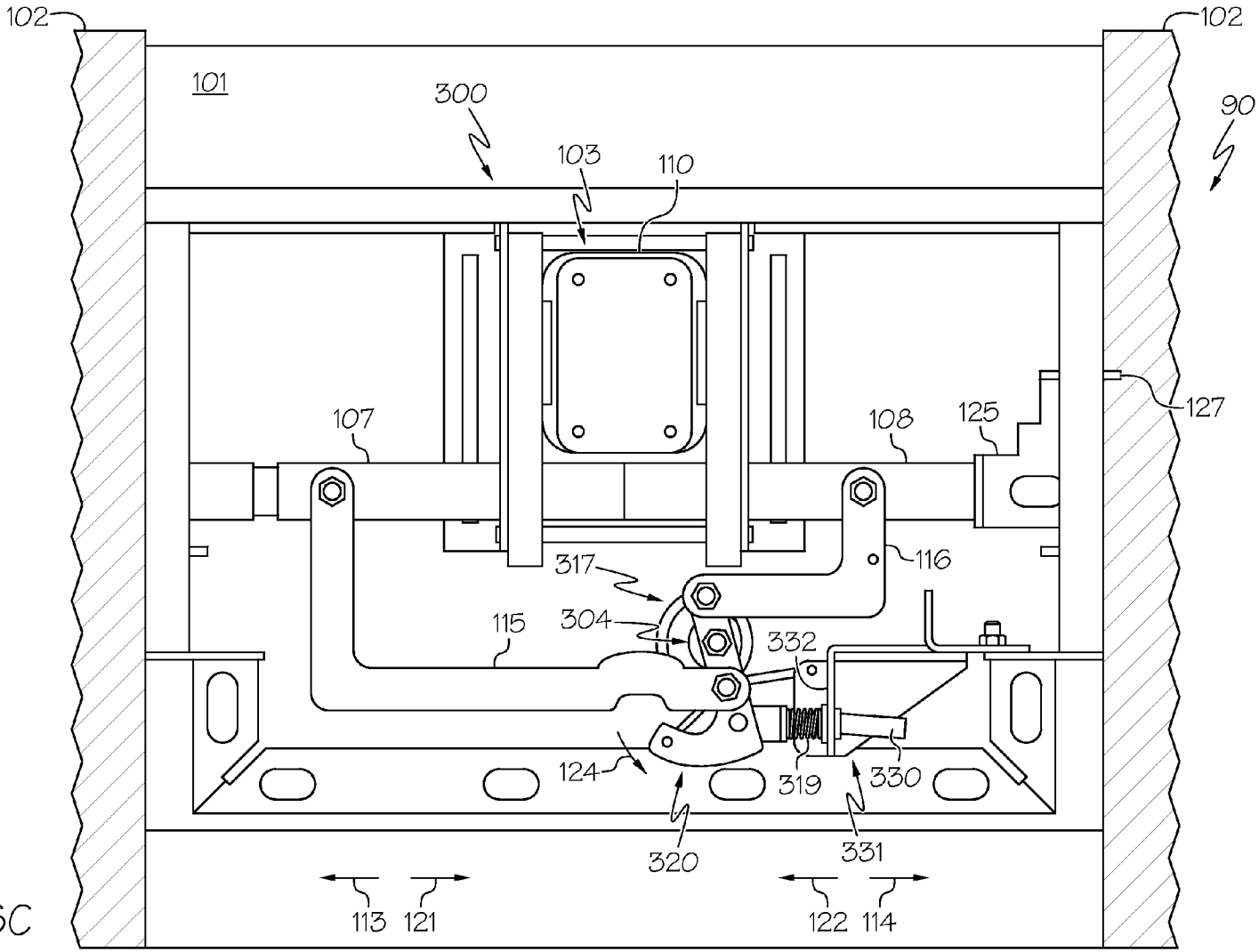
FIG. 6C schematically depicts the inward facing surface of the door and the locking mechanism of FIG. 6A in an unlocked and unlatched position according to one or more embodiments shown or described herein.

Upon contact with the bracket 331, the second biasing member 319 applies a force to the cam 320 that opposes the first biasing member 317. In this way, the second biasing member 319 acts to maintain the locking mechanism in the unlocked and latched position, as describe above with respect to FIGS. 3A-3C. Referring to FIG. 6C, by rotating the handle 205 (FIG. 4A), a user may reposition the locking mechanism 300 into the unlocked and latched position, as described above with respect to FIGS. 4A-4D.

It should now be understood that security containers according to the present disclosure include a locking mechanism that provides a visual indication of whether the security cabinet is locked or unlocked. The security containers include a handle assembly that is coupled to the locking mechanism. The handle assembly may be positioned in at least three positions corresponding to the security container being locked and latched; being unlocked and latched; and being unlocked and unlatched. The handle assembly may include a first and a second spring that selectively position the handle assembly between the plurality of positions through selective contact with the components of the lock mechanism. Because the handle assembly is positioned in these plurality of positions that correspond to the lock and latch status of the locking mechanism, indication of the lock and latch status of the locking mechanism may be understood by visual inspection.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A locking mechanism comprising:

a door comprising an interior facing surface and an exterior facing surface;

a handle assembly comprising a cam that is positioned on the interior facing surface of the door and a handle that is coupled to the cam and is positioned on the exterior facing surface of the door, wherein the handle is selectively repositionable between a locked handle position and an unlocked and latched handle position;

an engagement bolt coupled to the cam and slidably mounted to the interior facing surface of the door;

a biasing member coupled to the engagement bolt, wherein the biasing member applies a force to the engagement bolt biasing the engagement bolt in an inward direction; and a lock comprising a lock housing and a locking bolt that is selectively repositionable between a locked position to inhibit translation of the engagement bolt and an unlocked position to allow translation of the engagement bolt;

wherein the handle is biased toward the unlocked and latched handle position with the locking bolt in the unlocked position.

2. The locking mechanism of claim 1, wherein the handle pivots about the cam and the handle is oriented in a first rotational position in the locked handle position and a second rotational position in the unlocked and latched handle position.

3. The locking mechanism of claim 1, wherein the engagement bolt is coupled to the cam through an engagement leg that is pivotally coupled to the cam.

4. The locking mechanism of claim 1, wherein the engagement bolt is a first engagement bolt and the locking mechanism further comprises a second engagement bolt coupled to the cam and slidably mounted to the interior facing surface of the door.

5. The locking mechanism of claim 4, wherein the first engagement bolt is coupled to the cam through a first engagement leg that is pivotally coupled to the cam and the second engagement bolt is coupled to the cam through a second engagement leg that is pivotally coupled to the cam.

6. The locking mechanism of claim 5, wherein the biasing member is a first biasing member that is coupled to the door and the first engagement leg.

7. The locking mechanism of claim 5 wherein the biasing member is a first biasing member that is coupled to the cam and the door.

8. The locking mechanism of claim 5, wherein the biasing member is a first biasing member and the locking mechanism further comprises a second biasing member that is coupled to at least one of the cam or the door.

9. The locking mechanism of claim 8, further comprising a guide that is pivotally coupled to the cam, wherein the second biasing member is pivotally coupled to the cam and is positioned on the guide.

10. The locking mechanism of claim 8, wherein the second biasing member is coupled to the door and comprises a plunger spring.

11. The locking mechanism of claim 8, wherein when the handle is in the unlocked and latched handle position, the second biasing member applies a force to the cam that opposes the first biasing member, maintaining the handle in the unlocked and latched handle position.

12. A locking cabinet comprising:

a frame;

a door slidably coupled to the frame, the door comprising an interior facing surface and an exterior facing surface;

a locking mechanism comprising:

a handle assembly comprising a cam that is positioned on the interior facing surface of the door and a handle that is coupled to the cam and is positioned on the exterior facing surface of the door, wherein the handle is selectively repositionable between a locked handle position, an unlocked and latched handle position, and an unlocked and unlatched handle position;

a first engagement bolt coupled to the cam and slidably mounted to the interior facing surface of the door, wherein the first engagement bolt is selectively engaged with the frame;

a second engagement bolt coupled to the cam and slidably mounted to the interior facing surface of the door, wherein the second engagement bolt is selectively engaged with the frame;

a first biasing member coupled to the first engagement bolt, wherein the first biasing member applies a force to the first engagement bolt biasing the first engagement bolt in an inward direction; and a lock comprising a lock housing and a locking bolt that is selectively repositionable between a locked position and an unlocked position, wherein when the locking bolt is in the unlocked position, the first biasing member applies the force to the first engagement bolt and the cam, biasing the handle into the unlocked and latched handle position.

13. The locking cabinet of claim 12, wherein the handle pivots about the cam and the handle is oriented in a first rotational position in the locked position, a second rotational position in the unlocked and latched position, and a third rotational position in the unlocked and unlatched position.

14. The locking cabinet of claim 12, wherein when the handle is in the locked handle position, the first engagement bolt and the second engagement bolt are engaged with the frame, and when the handle is in the unlocked and latched handle position, the first engagement bolt and the second engagement bolt are at least partially withdrawn from the frame.

15. The locking cabinet of claim 12, wherein when the handle is in the unlocked and unlatched handle position, the first engagement bolt and the second engagement bolt are fully withdrawn from the frame.

16. The locking cabinet of claim 12, wherein the locking mechanism further comprises a latch coupled to the door, wherein the latch comprises a tab that engages the frame.

17. The locking cabinet of claim 16, wherein the second engagement bolt comprises a recess and the latch engages the recess when the handle is in the unlocked and unlatched handle position.

18. The locking cabinet of claim 12, wherein the locking mechanism further comprises a second biasing member that is coupled to at least one of the cam or the door.

19. The locking cabinet of claim 18, further comprising a guide that is pivotally coupled to the cam, wherein the second biasing member is pivotally coupled to the cam and is positioned on the guide, and when the lock is in the unlocked position, the second biasing member applies a force to the cam that opposes the first biasing member such that the handle is biased to the unlocked and latched handle position.

20. The locking cabinet of claim 18, wherein the second biasing member is coupled to the door and comprises a plunger spring and when the lock is in the unlocked position, the second biasing member applies a force to the cam that opposes the first biasing member such that the handle is biased to the unlocked and latched handle position.

* * * * *